United States Patent [19]

Kunka et al.

[11] Patent Number: 4,722,467

[45] Date of Patent: Feb. 2, 1988

[54] WIRE GUIDE APPARATUS FOR WIRE STITCHING MACHINE HEAD

[75] Inventors: Bernard P. Kunka; Casper W. Hagemann, both of Racine, Wis.

[73] Assignee: Interlake, Inc., Oak Brook, Ill.

[21] Appl. No.: 872,235

[22] Filed: Jun. 9, 1986

[51] Int. Cl.[4] ..... B27F 7/28

[52] U.S. Cl. ..... 227/82; 227/90

[58] Field of Search ..... 227/82, 90, 156

[56] References Cited

U.S. PATENT DOCUMENTS

| | | | |
|---|---|---|---|
| 1,252,011 | 1/1918 | Maynard . | |
| 2,884,635 | 5/1959 | Hager | 227/90 |
| 3,747,825 | 7/1973 | Barland | 227/90 |
| 4,211,350 | 7/1980 | Kunka et al. | 227/90 X |
| 4,410,123 | 10/1983 | Kunka et al. | 227/90 X |

OTHER PUBLICATIONS

Interlake Instruction Manual for Single and Multiple Head Champion Stitchers, form 1132 R5-80, 1980.

*Primary Examiner*—Paul A. Bell

*Attorney, Agent, or Firm*—Emrich & Dithmar

[57] ABSTRACT

A cyclical wire stitching machine head includes a reciprocating staple-forming and driving apparatus which is coupled to a wire gripping and feeding mechanism which reciprocates with it. During each cycle of the machine the supply wire is gripped and a predetermined length thereof is fed through a cutter to a holder and severed while, simultaneously, the length severed in the preceding cycle is formed into a staple and driven through the work against a clincher. On the retraction stroke, the holder is rotated to bring the severed length of wire into position for forming and driving during the next drive stroke. A guide tube positively guides and supports the unstraightened wire from a supply coil along a feed path from the input end of the head to the gripping and feeding mechanism. Guide means are also provided for guiding the wire from the cutter to the holder while accommodating rotation of the severed length of wire with the holder.

14 Claims, 8 Drawing Figures

WIRE GUIDE APPARATUS FOR WIRE STITCHING MACHINE HEAD

BACKGROUND OF THE INVENTION

The present invention relates to a wire stitching or stapling machine of the type which servers and forms staples from a continuous wire and drives the staples into an associated workpiece. In particular, the invention relates to a stitching head for such a machine.

The present invention is an improvement of the wire stitching machine sold by Interlake, Inc., the assignee of the present invention, under the trademark "CHAMPION STITCHER". This prior stitching machine, which is in turn an improvement of the machine described in U.S. Pat. No. 1,252,011, includes a stitching head having a wire feed mechanism for feeding a predetermined length of wire from a continuous coiled supply to a rotatable wire holder through a cutter which severs the length of wire from the supply, and through a staple-forming and driving mechanism which cooperates with the holder for forming the severed length of wire into a staple and driving it into an associated workpiece against a clincher. The mechanism undergoes a cyclical reciprocating movement comprising a drive stroke and a return stroke. During each drive stroke the feed mechanism feeds a predetermined length of wire to the wire holder, while the staple-forming and driving means is forming and driving the length of wire which had been fed and severed during the preceding drive stroke. Both mechanisms then retract simultaneously, and at the end of each cycle there is left in the wire holder a severed length of wire ready to be formed and driven during the next drive stroke.

When the wire is withdrawn from the supply coil it is not straight, but rather has a certain curvature as a result of manufacturing processes. During each cycle, the wire is severed at the cutter so that, during the next cycle, the leading end of the wire must travel from the cutter to the wire holder which is spaced a predetermined distance from the cutter. While this distance is not great, typically being less than one inch, it is sufficient that the curvature in the uncoiled supply wire will cause the leading end to stray from the feed path and miss the narrow entrance aperture into the holder. Therefore, the prior stitching head includes wire straighteners for removing the curvature from the wire in two different planes before it reaches the gripping and feeding mechanism.

These straighteners comprise pairs of rollers separated by an adjustable cam. The presence of these straighteners makes threading of the wire into the stitching head a complex and exacting procedure. The threading of the wire through the straighteners must be carefully done to insure that the wire is accurately seated in the straighteners. Then, the wire is fed through a check pawl to prevent reverse movement, then through a channel in the cutter and into the entrance aperture of the wire holder. Then a trial and error procedure ensues to obtain the right degree of straightening. Thus, in some applications, the straighteners are first set to a nominal position, the machine is cycled a few times and the wire is cut off just ahead of the cutter. The distance of the free end of the wire from the face plate of the head in a front-to-back direction, and its lateral distance from the center line of the feed path are then manually measured to see if they are within specifications. If they are not, adjustments are made to the straighteners and this process is repeated until an accurate feed is accomplished. As a result, the threading procedure must be done by trained technicians. This is not a serious drawback in some applications, such as in the printing and binding fields, wherein there are long runs of many cycles of stapling standard-thickness workpieces. In such applications there is a commonly a technician permanently on-site.

However, the stitching machine head also has application in office environments, such as in connection with copying machines and the like. In such applications, there is no technician on-site and, therefore, rethreading of the machine, which must be accomplished at least each time the supply coil is exhausted, would require a service call to the technician. The expense of such service calls is a severe disadvantage to the use of the stitching machine head in office applications.

SUMMARY OF THE INVENTION

It is a general object of the invention to provide an improved stitching machine head which avoids the disadvantages of prior heads while affording additional structural and operating advantages.

An important feature of the invention is the provision of a stitching machine head which permits the threading of wire thereinto by untrained personnel.

In connection with the foregoing feature, it is another feature of the invention to provide a stitching machine head of the type set forth, which provides a simplified and relatively trouble-free method of threading wire thereinto.

Another feature of the invention is the provision of a stitching machine head of the type set forth, which is usable with wire withdrawn directly from a supply coil without pre-straightening.

In connection with the foregoing feature, it is another feature of the invention to provide a stitching machine head of the type set forth which includes unique wire guide means which obviate the use of straigteners.

Still another feature of the invention is the provision of a simplified method for threading wire into a stitching head.

These and other features of the invention are attained by providing in a wire stitching machine head having a wire input end and a staple exit end, including a rotatable wire holder having an entrance aperture, means for gripping and feeding a length of wire to the holder from a continuous coiled supply thereof, a cutter spaced from the holder for severing the length of wire from the supply, and means cooperating with the holder for forming the severed length of wire into a staple and driving the staple through an associated workpiece and against a clincher, the improvement comprising: guide means disposed for supporting and positively guiding the length of wire along the entire distance from the cutter to the wire holder while accommodating rotation of the severed length of wire with the holder, whereby unstraightened wire as fed from the supply may accurately be fed to the entrance aperture of the wire holder during each operating cycle.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 2:
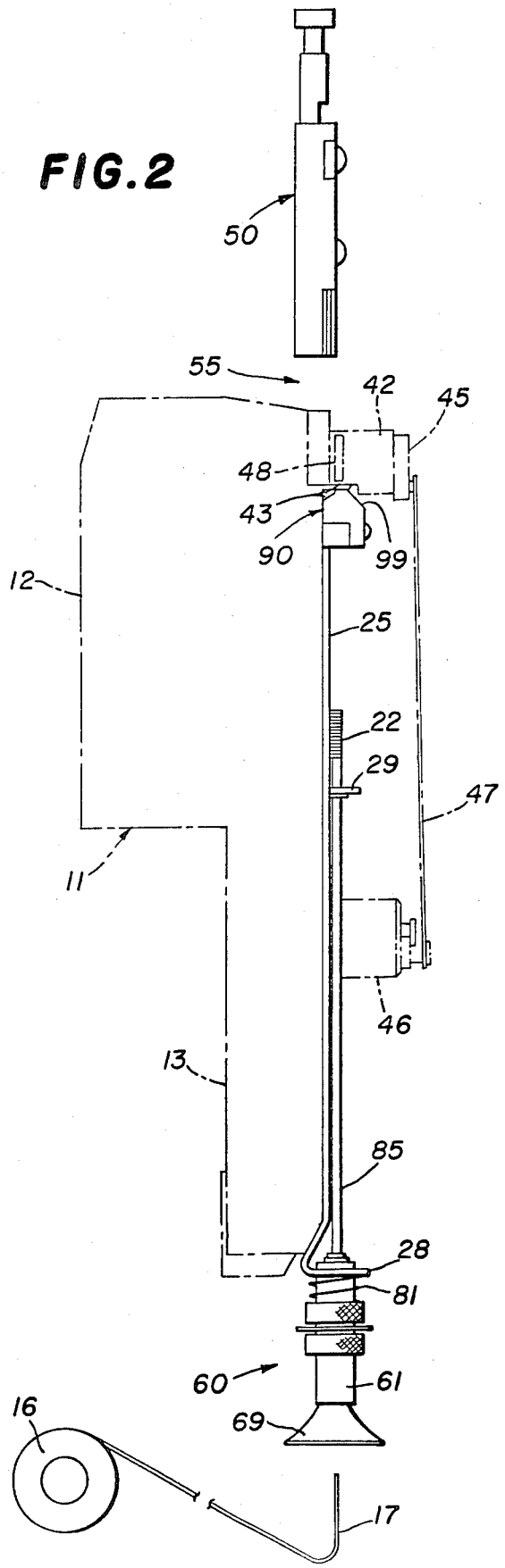
FIG. 2 is a side elevational view of the stitching head and associated clinching mechanism of FIG. 1, with portions of the head not pertinent to the present invention diagrammatically illustrated in phantom.
Figure 1:
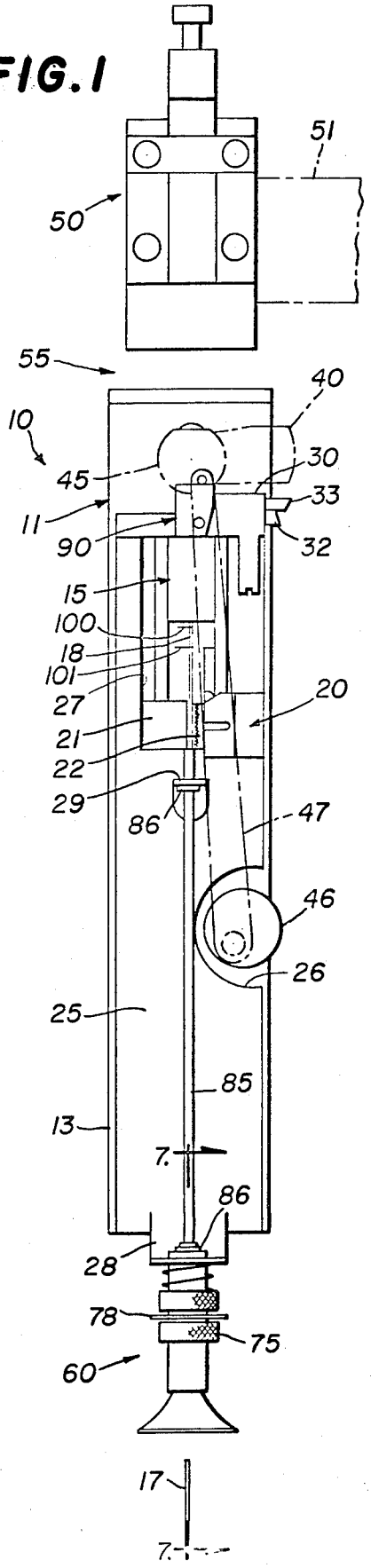
FIG. 1 is a front elevational view of the stitching head constructed in accordance with and embodying the features of the present invention, shown in its use configuration in relationship to an associated clinching mechanism.

Referring to FIGS. 1 and 2, there is illustrated a wire stitching head, generally designated by the numeral 10, which is very similar in construction to the stitching head disclosed in the aforementioned U.S. Pat. No. 1,252,011, and that used in the Interlake "CHAMPION STITCHER". But the stitching head 10 is inverted from the orientation shown in the '011 patent. Accordingly, only so much of the stitching head 10 as is necessary to an understanding of the operation of the present invention will be described herein in detail, and the aforementioned patent, and the instruction manual for the "CHAMPION STITCHER", filed herewith, may be referred to for a more specific disclosure of the construction and operation of the remainder of the stitching head 10.

The stitching head 10 includes a metal frame, generally designated by the numeral 11, which is preferably in the form of a single-piece casting. The frame 11 includes a channel-shaped base portion 12 provided with an elongated extension portion 13. Disposed in the frame 11 is an elongated drive slide assembly (not shown) adapted for sliding movement longitudinally of the frame 11. The drive slide assembly is coupled to a drive linkage of an associated machine (not shown), which could be stitching machine of the type described in the aforementioned '011 patent, or some other type of machine, such as an office copying machine or the like. The drive linkage operates to effect reciprocating movement of the drive slide assembly.

Coupled to the drive slide assembly is a stapleforming and driving assembly 15 adapted for vertical sliding movement in the frame 11 for forming a staple from a length of wire 17 which is drawn from a supply coil 16 in a known manner. Also mounted on the frame 11 is a wire gripping an feeding assembly 20, the construction and operation of which is described in the aforementioned '011 patent. The wire gripping and feeding assembly 20 includes a pair of gripping jaws 21 and 22 which operate to grip the supply portion of the wire 17 and to feed a predetermined length thereof for severing, formation into a staple and driving of the staple through an associated workpiece during each cycle of operation of the stitching head 10, all in a known manner.

The mechanism heretofore described is covered by a rectangular face plate 25 which is dimensioned to rest upon shoulders (not shown) of the frame 11. The face plate 25 has a large recess 26 formed in one side thereof, generally adjacent to a complementary cutout portion (not shown) in the frame 11. Also formed in the face plate 25 adjacent to the upper end thereof is a large rectangular aperture or window 27. The wire gripping and feeding assembly 20 extends forwardly through the window 27 in the face plate 25. The face plate 25 is also provided with an integral bottom tab 28 projecting forwardly therefrom at the lower end thereof and an upper tab 29 which is punched therefrom and projects forwardly therefrom just below the window 27, for a purpose to be explained more fully below.

Figure 4:
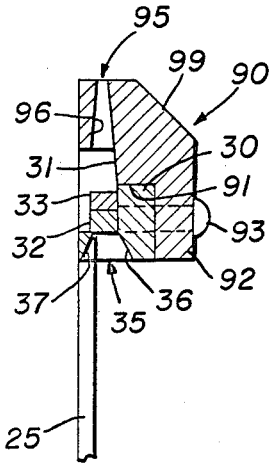
FIG. 4 is a fragmentary view in vertical section taken along the line 4—4 in FIG. 3.
Figure 3:
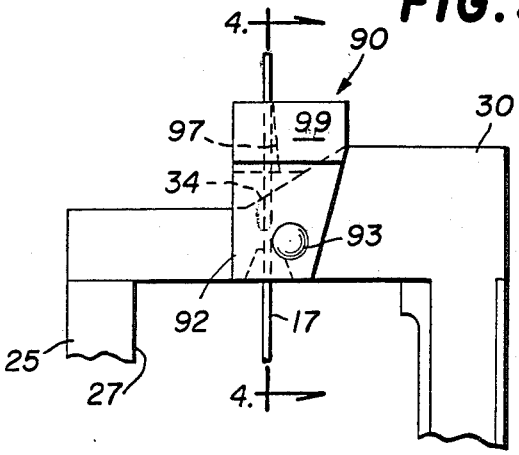
FIG. 3 is an enlarged, fragmentary, front elevational view of the cutter and associated guide of the head of FIGS. 1 and 2.

Fixedly secured to the face plate 25 at the upper end thereof is a cutter housing 30 having a channel 31 (see FIG. 4) formed in the rear surface thereof for accommodating therein a fixed cutter 32 and a movable cutter 33 which cooperate in a manner fully described in the aforementioned '011 patent to severe a length of the wire 17 from the supply portion thereof. Referring also to FIGS. 3 and 4, the cutter housing 30 has an inclined wall portion 34 at the upper end thereof and is provided with a channel 35 extending vertically therethrough from the lower edge thereof, which is substantially flush with the top of the window 27, to the inclined wall portion 34, the channel 35 having a funneled entrance portion 36, 37 formed in the cutter housing 30 and the face plate 25.

Fixedly secured to the frame 11 at the upper end thereof is a bracket 40 which extends laterally across the front of the frame 11 and has formed at the distal end thereof a cylindrical sleeve 42. The sleeve 42 has a recess 43 in the bottom thereof adjacent to the face plate 25. Rotatably disposed in the sleeve 42 coaxially therewith is a cylindrical wire holder 45 which has an enlarged part-circular head which limits the depth of insertion of the wire holder 45 in the sleeve 42. The wire holder 45 is similar in construction and operation to that disclosed in FIG. 9 of the '011 patent. Rotation of the wire holder 45 is effected by a cylindrical operating cam 46, which is formed as explained in the '011 patent. The outer end of the operating cam 46 is fixedly secured to one end of the elongated operating spring arm 47, the other end of which is coupled to the wire holder 45. In operation, as the drive slide assembly moves upwardly, the operating cam 46 rotates to effect a corresponding rotation and outward movement of the wire holder 45, the spring action of the operating spring arm 47 also serving resiliently to urge the wire holder 45 axially into the cylindrical sleeve 42.

The stitching head 10 operates in conjunction with a clincher assembly 50 which is mounted by a suitable mounting bracket 51 immediately above the upper end of the stitching head 10, being separated therefrom by a workpiece space 55 to accommodate insertion of the workpiece to be stapled. Preferably, the clincher assembly 50 is a bypass clincher of the type disclosed in copending application Ser. No. 729,422, filed May 1, 1985 and entitled "Bypass Clincher for a Stitching Machine", now U.S. Pat. No. 4,593,847, assigned to the assignee of the present invention, and the disclosure of which application is incorporated herein by reference. The clincher assembly 50 is operated by a suitable linkage (not shown) coupled to the drive mechanism for the stitching head 10 so as to operate in synchronism therewith, in a known manner.

Figure 7:
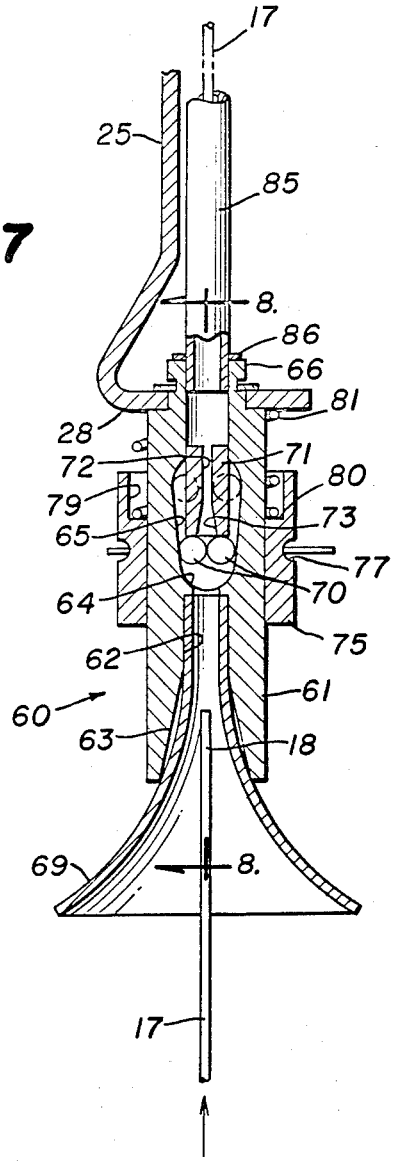
FIG. 7 is an enlarged fragmentary view in vertical section taken along the line 7—7 in FIG. 1.
Figure 8:
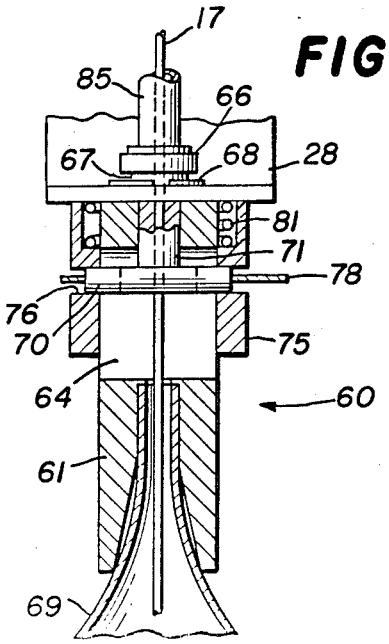
FIG. 8 is a fragmentary view in vertical section taken along the line 8—8 in FIG. 7.

Referring now also to FIGS. 7 and 8, the stitching head 10 is provided with a check pawl assembly 60, including an elongated cylindrical body 61 having an axial bore 62 therethrough provided with a tapered inlet end 63. Extending diametrically through the cylindrical body 61 intermediate the ends thereof is a lateral bore 64 which communicates with the axial bore 62 and is provided with downwardly converging cam walls 65. The cylindrical body 61 is provided at the upper end thereof with a reduced-diameter mounting neck 66 adapted to the received through a complementary opening in the bottom tab 28 of the face plate 25. The mounting neck 66 has a circumferential groove 67 in the outer surface thereof for receiving a C-clip 68 for cooperation with the tab 28 securely to fasten the check pawl assembly 60 thereto. Mounted in the lower end of the axial bore 62, as by press-fitting, is an input horn 69 to facilitate insertion of the wire 17 into the bore 62, as will be explained more fully below.

Disposed in the lateral bore 64 is a pair of pins 70 arranged side-by-side and dimensioned so that each has a diameter slightly greater than one-half the width of the lateral bore 64 at the lower end thereof. Freely riding on the pins 70 is a cylindrical bushing 71 having an axial bore 72 with a tapered inlet 73 at the lower end thereof, the upper end of the bushing 71 projecting into the upper end of the axial bore 62 above the lateral bore 64 and being axially slidably movable therein.

The check pawl assembly 60 is also provided with a cylindrical sleeve 75 which is slidably received over the cylindrical body 61 coaxially therewith, and is provided with a lateral slot 76 extending diametrically therethrough (see FIG. 8). The sleeve 75 is also provided with a circumferential grove 77 (see FIG. 7) in the outer surface thereof intermediate the upper and lower ends thereof for receiving therein a C-clip 78. The slot 76 has a vertical width slightly greater than the diameter of the pins 70 to permit insertion thereof into the lateral bore 64 through the lateral slot 76. The length of the pins 70 is slightly greater than the outer diameter of the cylindrical body 61 so that they project in use into the lateral slot 76, being retained in place by the C-slip 78.

The upper end of the sleeve 75 is provided with an enlarged-diameter countersink 79 therein defining an annular seat 80 in which is received a helical compression spring 81 disposed in surrounding relationship with the upper end of the cylindrical body 61. The spring 81 bears against the bottom of the bottom tab 28 for resiliently urging the sleeve 75 downwardly to a normal locking position illustrated in FIG. 7. In this locking position, the pins 70 are wedged together into the lower end of the lateral bore 64. The sleeve 75 may be manually raised, against the urging of the spring 81, to a release position, illustrated in FIG. 8, bearing against the tab 28 and raising the pins 70 to the widened upper end of the lateral bores 64 so that they can be separated to accommodate passage of the wire 17 therebetween.

The stitching head 10 is also provided with an elongated threading guide tube 85 which is vertically disposed along the front surface of the face plate 25 centrally thereof. More particularly, the lower end of the guide tube 85 is slip-fitted into the upper end of the axial bore 62 in the cylindrical body 61 of the check pawl assembly 60. The upper end of the guide tube 85 is received through a complementary opening in the upper tab 29 on the face plate 25, being fixedly secured in place by two suitable mounting clips 86, respectively at the tab 29 and the top of the mounting neck 66 of the check pawl 60 (see FIG. 1). The guide tube 85 defines a vertical feed path for the wire 17 from the lower wire input end of the stitching head 10 to the lower end of the window 27 at the wire gripping and feeding assembly 20. In particular, the guide tube 85 is aligned with the path between the gripper jaws 21 and 22 for guiding and supporting the wire 17 along the feed path from the check pawl assembly 60 to the wire gripping and feeding assembly 20.

Figure 5:
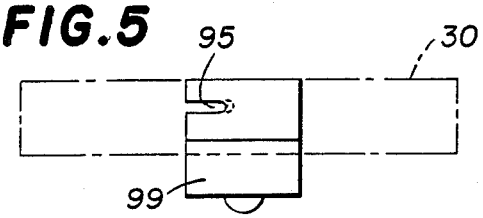
FIG. 5 is a top plan view of the guide of FIG. 3.
Figure 6:
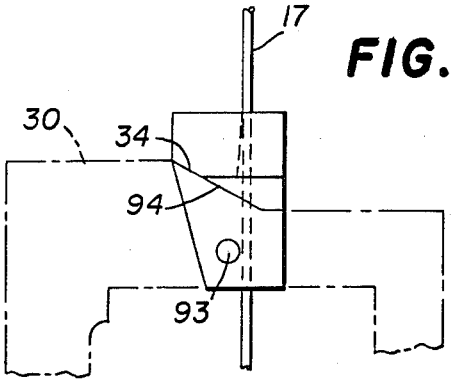
FIG. 6 is a rear elevational view of the guide of FIG. 3.

There is also provided a guide body 90 for guiding the wire 17 from the cutter housing 30 to the wire holder 45. The guide body 90 has a notch 91 formed in the rear surface thereof to receive the cutter housing 30, the notch 91 serving to define a mounting finger 92 at the front of the guide body 90 which depends downwardly along the front surface of the cutting housing 30 and is fixedly secured thereto by suitable means such as a rivet 93. The notch 91 defines a sloping mounting wall 94 (see FIG. 6) which is dimensioned and arranged to mate with and rest upon the inclined wall portion 34 of the cutter housing 30. Formed in one side of the guide body 90 is a guide slot 95 which extends vertically from the top of the guide body 90 to the notch 91 (see FIGS. 4 and 5). The guide slot 95 has upwardly converging tapered front and back walls 96 and and a tapered lateral wall 97 (see FIG. 3) to a facilitate insertion of the wire 17 into the guide slot 95. The guide body 90 has a beveled front surface 99 at the upper end thereof to provide clearance for the wire holder sleeve 42 (see FIG. 2). Also, it will be appreciated that the recess 43 in the bottom of the sleeve 42 permits the guide body 90 to extend up substantially to the wire holder 45.

The operation of the stitching head 10 will now be explained in detail. The drive mechanism of the stitching heda 10 is so arranged that, when the stitching head 10 is in its normal rest condition, illustrated in FIGS. 1 and 2, the gripping jaws 21 and 22 are disposed at the bottom of the window 27 in an open, spaced-apart condition. In threading the wire 17 into the stitching head 10, the user manually grasps the supply portion of the wire 17 as it exits the supply coil 16 and pushes the leading end 18 upwardly into the check pawl assembly 60, as indicated in FIG. 7. While the coil 16 is shown laterally displaced from the axis of the feed path through the head 10 in FIG. 2, this is simply for economy of space in the drawing. Normally, the supply path from the coil 16 will have a substantial vertical extent leading into the input horn 69. In order to permit insertion of the wire 17 through the check pawl assembly 60, the sleeve 75 is moved up to the release position, permitting the leading end 18 of the wire 17 to pass freely between the pins 70.

The wire 17 cannot be misfed in the check pawl assembly 60, since the bushing 71 rests directly on the pins 70, so that when the wire 17 passes between the pins 70 it enters directly into the tapered inlet 73 of the bushing 71. Similarly, it will be noted that when the sleeve 75 is disposed in its release condition, the bushing 71 is pushed up against the lower end of the threading guide tube 85, so that the wire 17 is positively guided into the tube 85.

The user continues to manually push the wire 17 upwardly through the tube 85 until the leading end 18 thereof exits the tube 85 and passes between the gripper jaws 21 and 22. The wire 17 is fed until the leading 18 thereof is disposed in a region between a pair of guide marks 100 and 101 on the face of the staple forming and driving assembly 15 (see (FIG. 1). The spacing between the guide marks 100 and 101 is sufficient to permit easy determination of the proper threaded position of the leading end 18 of the wire and obviate any precise positioning by the user. Then the sleeve 75 is released to its locking position to prevent vertical downward movement of the wire 17.

The stitching head 10 is then cycled three times. During the first cycle the wire gripping and feeding assembly 20 grips the wire 17 and feeds a predetermined length thereof, such that the leading end 18 of the wire will enter the channel 35 in the cutter housing 30. The widely beveled entrance aperture 36 of the channel 35 facilitates insertion of the leading end 18 of the wire thereinto, despite any slight curvature which might exist in the short unsuported extent of the wire 17 which extends above the gripper jaws 21 and 22.

While the leading end 18 of the wire 17 will enter the cutter housing 30 during the first cycle, it may not be inserted therein a sufficient depth to be cut by the cutters 32 and 33, because of the threading margin provided between the guide marks 100 and 101. On the second cycle a second predetermined length of wire will be fed, pushing the leading end 18 of the wire 17 up through the guide slot 95 in the cutter guide body 90 and into the entrance aperture 48 of the channel through the wire holder 45, insertion into the guide slot 95 being facilitated by the tapered walls 96 and 97 thereof. Since the top of the cutter guide body 90 is disposed substantially at the entrance aperture 48 into the wire holder 45, accurate feeding of the wire thereinto is assured. During this second cycle the length of wire fed into the wire holder 45 will be severed by the cutters 32 and 33 and, upon the retraction stroke of the drive slide assembly, this severed length of wire will be rotated with the wire holder 45 from a vertical to a horizontal position in a known manner, this rotation being accommodated by the open side of the guide slot 95.

However, if the wire was not cut during the first cycle, this severed length of wire will not be the proper length. Therefore, a third cycle is run to feed another length of wire into the wire holder 45, which will be of the proper length for forming a staple. Thus, after three cycles of the stitching head 10, the threading operation is completed and the head 10 is in condition for use. On the next cycle of the stitching head 10, the length of wire held in the wire holder 45 will be formed into a staple and driven into an associated workpiece against the clincher assembly 50, all in a well known manner.

It is a significant aspect of the present invention that, once the threading operation is completed, there is no unsupported and unguided length of wire in the stitching head 10. Since the guide body 90 guides and supports the wire along the entire distance from the cutter housing 30 to the wire holder 45, curvature in the wire 17 cannot adversely affect accurate feeding into the wir holder 45. While a short length of the wire 17 is unsupported above the gripper jaws 21 and 22 just after the manual threading operation, the widely beveled entrance aperture 36 into the cutter channel 35, ensures accurate entry of the leading end 18 of the wire 17 into the cutter housing 30, despite any curvature which might exist in the wire.

Thus, unstraightened wire can be fed directly from the supply coil 16 without the use of any straighteners. Removal of the straighteners from the face plate 25 permits space for mounting of the threading guide tube 85. The use of the in-line check pawl assembly 60 also serves to simplify the threading operation. There results a guide assembly for a stitching head which permits threading of unstraightened wire directly from the supply coil by untrained personnel, while ensuring accurate threading and feeding of the wire. This results in a stitching head which is uniquely adaptable for use in office copying machines or the like, in places where trained service personnel are not normally available.

We claim:

1. In a wire stitching machine head having a wire input end and a staple exit end, including a rotatable wire holder having an entrance aperture, means for gripping and feeding a length of unstraightened wire to the holder from a continuous coiled supply thereof, a cutter assembly spaced from the holder for severing the length of wire from the supply, and means cooperating with the holder for forming the severed length of wire into a staple and driving the staple through an associated workpiece and against a clincher, the improvement comprising: guide means disposed for supporting and positively guiding the length of wire along the entire distance from the cutter assembly to the wire holder without straightening the wire while accommodating rotation of the severed length of wire with the holder, whereby unstraightened wire as fed from the supply may accurately be fed to the entrance aperture of the wire holder during each operating cycle.

2. The stitching machine head of claim 1, and further comprising means mounting said guide means on the cutter assembly.

3. The stitching machine head of claim 1, wherein said guide means includes a solid body having a guide slot formed therein so as to define a guide channel which is open on one side.

4. The stitching machine head of claim 3, wherein said guide channel is tapered from a wide entry end adjacent to the cutter assembly to a narrow exit end adjacent to the entrance aperture of the wire holder.

5. The stitching machine head of claim 3, wherein said body is shaped and dimensioned to accommodate rotation of the wire holder.

6. The stitching machine head of claim 1, wherein the cutter assembly has a wire passage therethrough, said passage being enlarged at the input end thereof to facilitate threading of the leading end of the supply wire thereinto.

7. In a wire stitching machine head having a wire input end and a staple exit end, including a rotatable wire holder, means for gripping and feeding a length of unstraightened wire to the holder from a continuous coiled supply thereof, a cutter assembly spaced from the holder for severing the length of wire from the supply, and means cooperating with the holder for forming the severed length of wire into a staple and driving the staple through an associated workpiece and against a clincher, improved threading means for said head comprising: elongated threading guide means extending from the wire input end of the head to the gripping and feeding means, said guide means defining a feed path and being adapted to receive unstraightened wire from the supply and to support and guide the wire along said feed path and accurately into the gripping and feeding means without straightening the wire, and second guide means disposed for supporting and positively guiding the length of wire along the entire distance from the cutter assembly to the wire holder without straightening the wire while accommodating rotation of the severed length of wire with the holder.

8. The wire stitching machine head of claim 7, wherein said threading guide means comprises an elongated tube.

9. The wire stitching machine head of claim 7, and further comprising support tabs projecting from the head at spaced-apart locations thereon for supporting said threading guide means adjacent to opposite ends thereof.

10. The wire stitching machine head of claim 9, and further comprising clip means for mounting said threading guide means on said support tabs.

11. The wire stitching machine head of claim 7, and further comprising check pawl means disposed adjacent to the input end of said threading guide means for receiving the supply wire therethrough prior to entry into said threading guide means, said check pawl means accommodating movement of the wire therethrough in a threading direction toward the gripper but preventing movement of the wire in the opposite direction.

12. A method for threading wire from a continuous coiled supply thereof into a cyclically operating wire stitching machine head which has a wire input end and includes a gripper operable during each cycle for gripping and feeding a length of unstraightened supply wire to a rotatable wire holder through a cutter assembly for severing the length of wire held by the holder, and means operable during each cycle for forming a previously severed length of wire into a staple and driving it through an associated workpiece and against a clincher, the method comprising the steps of: supporting and guiding the unstraightened supply wire along the entire length thereof extending from the wire input end of the head to the gripper along a feed path without straightening the wire, pushing the supply wire along the feed path in a feeding direction until the leading end thereof extends a predetermined distance past the gripper, then operating the head through three staple-forming cycles to bring the head to a threaded and ready condition, and supporting and guiding the unstraightened supply wire along the entire distance form the cutter assembly to the wire holder during each cycle of operation while accommodating rotation of the severed length of wire with the holder.

13. The method of claim 12, and further comprising the step of preventing movement of the wire in a direction opposite to the feeding direction.

14. The method of claim 12, wherein the wire is manually threaded into the head.

* * * * *